United States Patent [19]

Katsu et al.

[11] Patent Number: 4,974,976

[45] Date of Patent: Dec. 4, 1990

[54] PRINTING HAMMER DEVICE

[75] Inventors: Masutaro Katsu; Kozo Yabukami, both of Nagoya, Japan

[73] Assignee: Brother Kogyo Kabushiki Kaisha, Nagoya, Japan

[21] Appl. No.: 333,863

[22] Filed: Apr. 6, 1989

Related U.S. Application Data

[63] Continuation of Ser. No. 19,919, Feb. 27, 1987, abandoned.

[30] Foreign Application Priority Data

Feb. 27, 1986 [JP] Japan ..... 61-29903[U]
Feb. 27, 1986 [JP] Japan ..... 61-29904[U]
Jun. 6, 1986 [JP] Japan ..... 61-86925[U]

[51] Int. Cl.[5] ..... B41J 9/38; B41J 9/42

[52] U.S. Cl. ..... 400/157.2; 400/144.2; 400/167; 101/93.02

[58] Field of Search ..... 400/144.2, 157.1, 157.2, 400/157.3, 167; 101/93.02, 93.18, 93.19, 93.29, 93.31, 93.32, 93.34, 93.48

[56] References Cited

U.S. PATENT DOCUMENTS

| | | | |
|---|---|---|---|
| 4,272,748 | 6/1981 | Fugate . | |
| 4,308,794 | 1/1982 | Adamoli et al. | 400/157.2 |
| 4,401,026 | 8/1983 | Brown . | |
| 4,422,784 | 12/1983 | Arzoumanian et al. | 400/157.2 |
| 4,430,936 | 2/1984 | Adamoli et al. | 400/157.2 |
| 4,505,604 | 3/1985 | Takemoto | 400/157.2 |
| 4,530,280 | 7/1985 | Kaneko et al. | 101/93.48 |
| 4,562,019 | 12/1985 | Inoue | 264/72 |
| 4,705,416 | 10/1987 | Asakura | 400/144.2 |

FOREIGN PATENT DOCUMENTS

| | | | |
|---|---|---|---|
| 142316 | 6/1980 | German Democratic Rep. | 400/157.2 |
| 231203 | 12/1985 | German Democratic Rep. | 101/93.02 |
| 234391 | 4/1986 | German Democratic Rep. | 400/157.2 |
| 75888 | 6/1981 | Japan | 400/157.2 |
| 56575 | 4/1985 | Japan | 400/144.2 |
| 68980 | 4/1985 | Japan | 400/157.2 |
| 11267 | 1/1986 | Japan | 400/157.2 |
| 53049 | 3/1986 | Japan | 400/144.2 |

OTHER PUBLICATIONS

D. A. Hall et al., "Inpact Printer Damping System"; *IBM Technical Disclosure Bulletin*; vol. 22, No. 8B, p. 3498; Jan. 1980; 400/167.

Anonymous; "Integrated Daisywheel Printer . . ."; *IBM Technical Disclosure Bulletin*; vol. 28, No. 4, Sep. 1985; pp. 1671–1672.

IBM Technical Bulletin, vol. 24, No. 12, Impression Control for a Typewriter.

*Primary Examiner*—David A. Wiecking
*Attorney, Agent, or Firm*—Jones, Tullar & Cooper

[57] ABSTRACT

A case member and a resilient supporting member are removably coupled to each other. The case member has a mounting portion mounted on a traveling member, which includes a carriage of a printing apparatus. The supporting member includes first and second portions which are formed integrally from a leaf spring material, and can be deformed elastically. A printing hammer, a bearing member supporting the hammer, a solenoid coil member for driving the hammer, a spring member used to return the hammer, a hammer socket receiving an impact from the hammer, and a shock absorbing rubber plate are coupled together and held between the case member and the supporting member. As the printing hammer moves to its return position, it abuts against the hammer socket, thereby moving it in a returning direction. Returning energy received from the hammer is transmitted to the first portion of the supporting member through the rubber plate, to be absorbed between the rubber plate and the supporting member, on the one side, and to the second portion of the supporting member, which is directly in contact with the hammer socket, on the other side.

16 Claims, 12 Drawing Sheets

PRINTING HAMMER DEVICE

This is a continuation of co-pending application Ser. No. 07/019,919, filed on Feb. 27, 1987, and now abandoned.

BACKGROUND OF THE INVENTION

The present invention relates to a printing hammer device which is adapted to be mounted on a printing apparatus, such as an impact printer, and performs a printing operation by striking, in a printing position, character elements arranged on a daisy wheel or the like.

In conventional printing hammer devices, such as the one disclosed in U.S. Pat. No. 4,401,026, front and rear mounting members, a coil bobbin, a resilient member, and a pair of yoke members are mounted in a case. The bearing members movably support striking and nonstriking-side end portions of a printing hammer. The coil bobbin is wound with a coil for magnetically driving the printing hammer, and has a center hole penetrated by the hammer. The resilient member is formed of a coil spring which causes the magnetically driven hammer to return to its initial position. The yoke members form a magnetic path which serves for the magnetic drive of the hammer. If the coil is supplied with an exciting current to produce a desired impact, corresponding to the printing-surface area of the character element situated in the printing position, the printing hammer is moved toward the character element, against the resilience of the resilient member, by a magnetic field which is generated in the magnetic path between the case, the yoke members, and the hammer. Thus, the character element is struck with the desired impact for printing.

According to the prior art printing hammer devices described above, however, it is difficult to maintain high concentricity in mounting the printing hammer, bearing members, yoke members, and coil bobbin in the case, due to the use of a good many components. Accordingly, the sliding resistance of the printing hammer, against the other components, is uneven, so that the character elements cannot be struck with the desired impact, thus lowering the print quality. Moreover, a number of components must be arranged in the case with high concentricity, so that the device inevitably is large-sized, and cannot be assembled with high efficiency.

If the mounting accuracy of the components is not high enough, the striking portion of the printing hammer cannot accurately face the character element in the printing position. In such a case, the character element may possibly be struck together with its adjoining one, thereby causing misprints. Therefore, the printing hammer device must be mounted with high positional accuracy, on a traveling member, such as a carriage, carrying a printing head. Thus, the mounting work requires much time, thereby further lowering the assembling efficiency.

In order to stabilize and increase the speed of the operation of the printing hammer, in the printing hammer devices of this type, rebounding of the hammer must be minimized, which may be caused when the hammer, moving to its initial position or rest position after the striking action, abuts against a hammer socket.

To cope with this, in the prior art printing hammer devices, the hammer socket, which moves in engagement with the nonstriking-side end of the printing hammer, returning toward its initial position by means of the resilience of the resilient member, is increased in mass. By doing this, the returning energy of the printing hammer can be absorbed by means of the hammer socket itself, as well as a shock absorbing member, which is subjected to elastic deformation as the hammer socket moves.

Disclosed in U.S. Pat. No. 4,272,748 is an arrangement including a print wire in which a precompressed elastomer material, is used as the shock absorbing member.

According to the conventional printing hammer devices described above, however, when the hammer socket is caused to return to its initial position, by the returning energy of the printing hammer, not absorbed by the shock absorbing member yet, as well as by the resilience of the shock absorbing member itself, the printing hammer, still subjected to a considerable reaction force from the hammer socket, cannot help moving again toward the character element. Thus, the hammer cannot be prevented effectively from rebounding. Therefore, it takes much time for the hammer to be settled in its initial position, so that the printing speed cannot be increased. If the printing hammer is operated without being stabilized, the impact on the character element cannot be uniform, thus failing to provide high-quality prints.

SUMMARY OF THE INVENTION

Accordingly, an object of the present invention is to provide a printing hammer device, in which various components can be mounted easily in a case, with high accuracy, in which a printing hammer can be driven securely to produce a desired impact for high-quality printing, and which enjoys improved assembling efficiency.

Another object of the invention is to provide a printing hammer device in which the printing hammer can be settled in its initial position in a short time, thus ensuring a high-speed printing operation and prints of further improved quality.

In order to achieve the above objects, a printing hammer device according to the present invention comprises a case member, a printing hammer including a striking-side end portion for striking character elements and a nonstriking-side end portion, bearing means for supporting the printing hammer on the case member, in a manner such that the hammer is movable between an initial position and an operative position, magnetic drive means for moving the printing hammer in one direction, resilient means for returning the printing hammer in the other direction, a hammer socket abutting against the nonstriking-side end portion of the printing hammer when the hammer is moved to the initial position, shock absorbing means for absorbing the impact of the printing hammer on the hammer socket, and a resilient supporting member including first and second portions resiliently engaging the shock absorbing means and the hammer socket, respectively.

According to the printing hammer device of the present invention, constructed in this manner, the sliding resistance of the printing hammer can be made substantially uniform, so that the character elements can be struck with the desired impact, thus ensuring high print quality. Moreover, the number of components used in the hammer device can be lessened, so that the device can be reduced in size, and its assembling efficiency can be improved.

According to an aspect of the invention, the case member, used to support the printing hammer, the coil, and the resilient means, can be coupled or formed integrally with a traveling member of a printing apparatus. Therefore, the printing hammer device can be mounted on the traveling member easily and with high accuracy. Thus, the mounting work can be improved in efficiency. Also, the striking-side end portion of the printing hammer can be opposed, at a desired distance, to the character element situated in the printing position, so that the character element can be struck with the desired impact, thereby ensuring high-quality printing.

In a preferred specific arrangement according to the present invention, moreover, an inertia member is interposed between the hammer socket and the resilient supporting member. When the printing hammer impacts against the hammer socket, the inertia member receives the returning energy of the hammer through the hammer socket, and transmits it to the shock absorbing means. Thus, the returning energy of the hammer is absorbed by the hammer socket, inertia member, shock absorbing means, and resilient supporting member. When the hammer socket and the inertia member return to their respective initial positions, vibration of the hammer socket is absorbed by the inertia member. Accordingly, the printing hammer can be stopped substantially from rebounding and settled in its initial position, in a relatively short time. Thus, the printing speed can be increased.

DETAILED DESCRIPTION OF THE PREFERRED EMBODIMENTS

Figure 1:
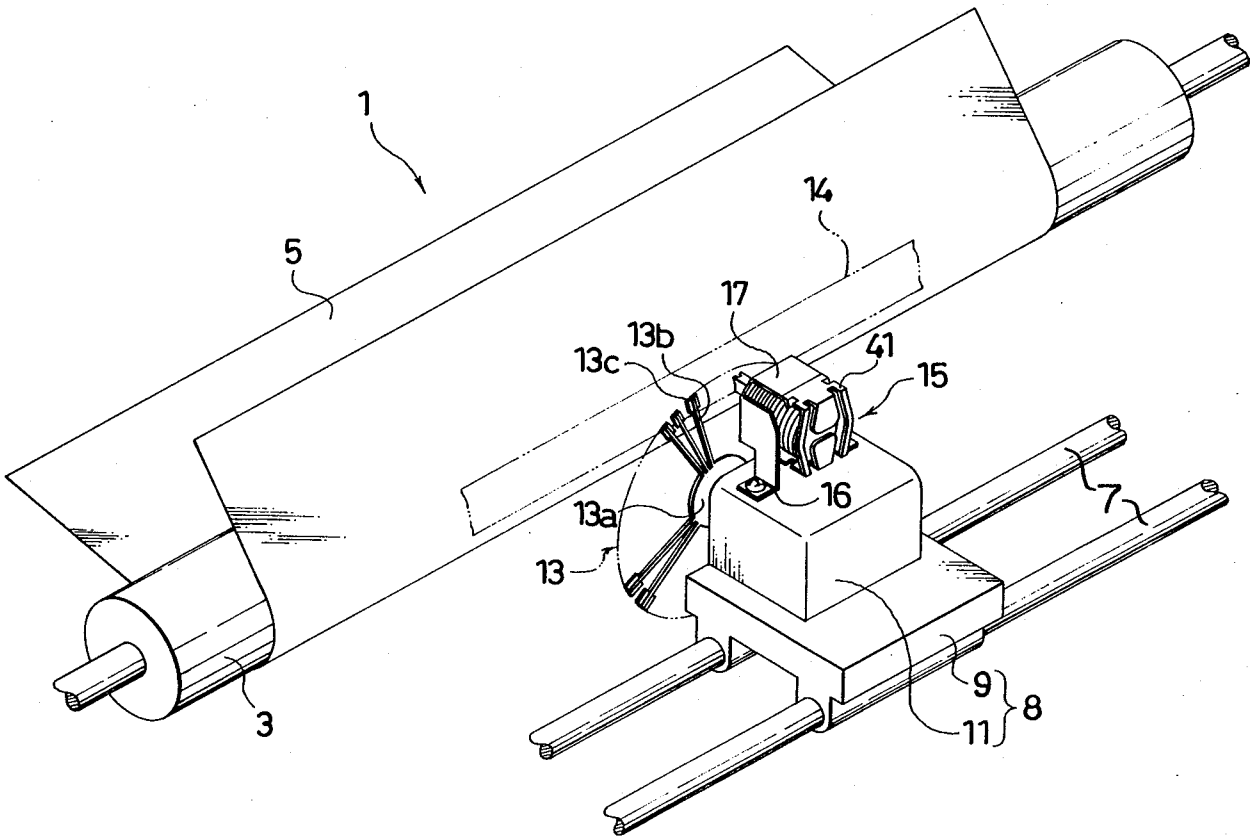
FIG. 1 is a perspective view showing a principal part of an impact printer having a printing hammer device according to a first embodiment of the present invention.

FIG. 1 is a schematic perspective view showing an outline of an impact printer which is provided with a printing hammer device according to a first embodiment of the present invention. A platen 3 is rotatably supported between a pair of frames (not shown) of a printer 1. Driven by a platen drive motor (not shown) coupled thereto, the platen 3 serves to feed a printing sheet 5 thereon. Two guide shafts 7 extend parallel to the axis of the platen 3, between the frames. A carriage 9, which constitutes a part of a traveling member 8, is supported on the guide shafts 7 so as to be slidable in the axial direction of the shafts 7. Driven by a carriage drive motor (not shown) coupled thereto, the carriage 9 is moved parallel to the printing line of the platen 3.

The carriage 9 carries thereon a character selection motor 11, such as a stepping motor, which constitutes another part of the traveling member 8. A daisy wheel 13, contained in a wheel cassette (not shown), is detachably mounted, for replacement, on the shaft of the selection motor 11. The daisy wheel 13 is composed of a boss **13*a* fitted on the motor shaft, a number of arms 13*b* extending radially from the outer periphery of the boss 13*a*, and character elements 13*c* formed individually on the respective tip ends of the arms 13*b***.

When the character selection motor 11 is driven for a desired number of steps corresponding to printing data, the daisy wheel 13 is rocked selectively so that the character element **13*c* responsive to the print data is situated in a printing position, where it faces the printing line of the platen 3. A printing hammer device 15 (described in detail later) is fixed directly to the top face of the character selection motor 11 by means of fixing screws 16. The hammer device 15 strikes the character element 13*c*, in the printing position, against a printing ribbon 14 on the printing sheet 5, with a desired impact. A ribbon cassette (not shown) is mounted on the carriage 9, for replacement, so that the printing ribbon 14, drawn out from the ribbon cassette, stretches between the platen 3 and the character element 13*c*, as indicated by chain line in FIG. 1**.

Figure 2:
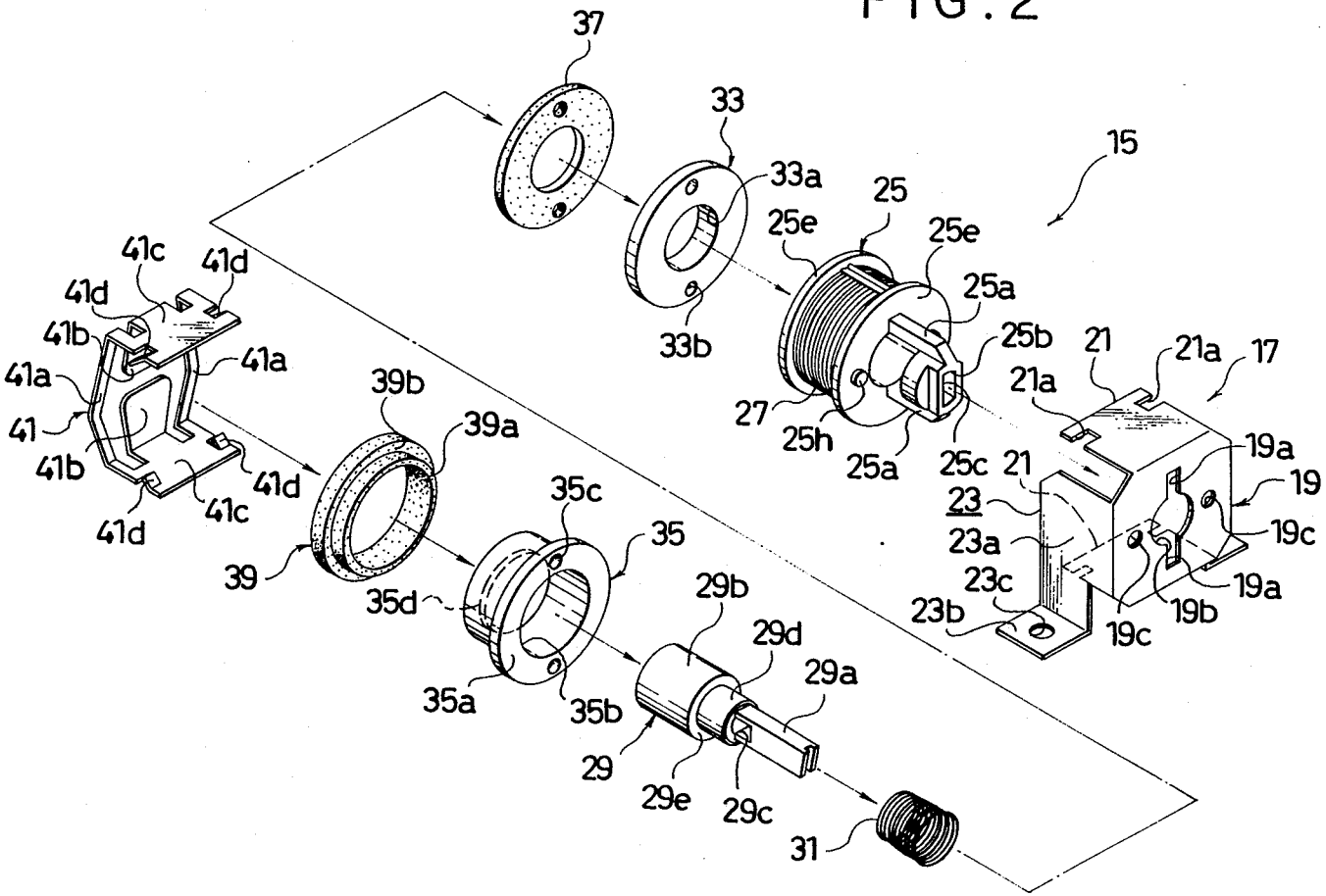
FIG. 2 is an exploded perspective view of the printing hammer device shown in FIG. 1.
Figure 3:
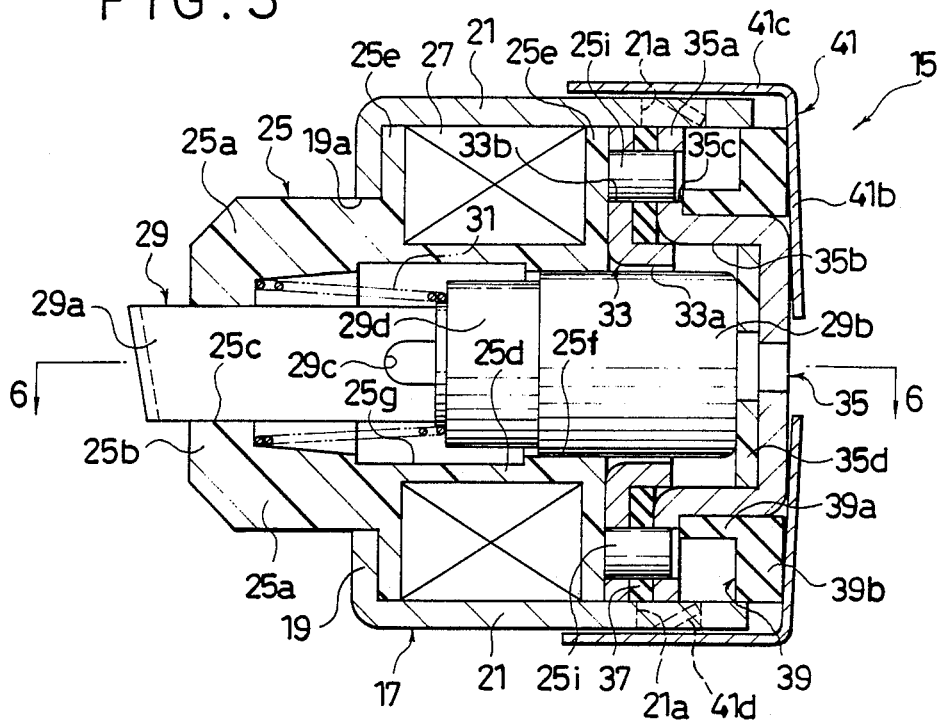
FIG. 3 is an enlarged longitudinal sectional view of the printing hammer device of FIG. 1, in a state such that its printing hammer is in its initial position.

FIG. 2 is an exploded perspective view of the printing hammer device 15, and FIG. 3 is a longitudinal sectional view of the assembled hammer device 15, as taken along its center line. A case member 17 of the printing hammer device 15 is formed of an integral metal plate which is bent by pressing. The case member 17 includes a front plate 19, top and bottom supporting plates 21, and a pair of lateral mounting plates 23. The front plate 19 is formed with an opening **19*b* which has top and bottom positioning notches 19*a*. A striking-side end portion of a bearing member 25 (mentioned later) is inserted in the notches 19*a* and the opening 19*b*. A pair of positioning apertures 19*c* are bored through the front plate 19, on either side of the opening 19*b*. The paired supporting plates 21, which face each other at a predetermined distance, extend from their corresponding ends of the front plate 19, in the opposite direction (hereinafter referred to as the backward direction) to the platen 3. A retaining notch 21***a* is formed on either side of the rear end portion of each supporting plate 21. Each mounting plate 23 is composed of a side wall portion 23*a* and a coupling portion 23*b*. The side wall portion 23*a* extends backward from each corresponding side end of the front plate 19, and then hangs down. The coupling portion 23*b*, which is formed with an aperture 23*c*, extends outward from the lower end of the side wall portion 23*a*. The respective rear ends of the supporting plates 21 and the mounting plates 23 are open.

The bearing member 25, made of synthetic resin, is inserted into the case member 17, through an opening which is defined by the open ends of the supporting plates 21 and the mounting plates 23. Upper and lower arm portions 25*a* and front-end bearing portion 25*b* are formed integrally on the striking side of the bearing member 25. The arm portions 25*a*, which extend toward the platen 3, are fitted in their corresponding notches 19*a*. The bearing portion 25*b* is fitted in the opening 19*b*. A bearing hole 25*c* is formed in the central portion of the front-end bearing portion 25*b*. A rearend bearing portion 25*d* and front and rear collar portions 25*e* are formed integrally on the nonstriking side of the bearing member 25. The rear-end bearing portion 25*d* is continuous with the arm portions 25*a*. The collar portions 25*e*, which are formed on the outer periphery of the bearing portion 25*d*, face each other at a predetermined distance, thus constituting a coil bobbin. A bearing hole 25*f* is formed in the central portion of the rear-end bearing portion 25*d*. A step portion 25*g* is formed on the inner peripheral surface of the bearing hold 25*f*, on the striking side thereof. The step portion 25*g* is larger in inside diameter than the bearing hole 25*f*. A coil 27 is wound around the outer peripheral surface of the rear-end bearing portion 25*d*, between the collar portions 25*e*, thus constituting an electromagnet. Corresponding to the apertures 19*c*, a pair of pins 25*h* are formed integrally on the front end face of the front collar portion 25*e*. Corresponding to apertures 33*b* (mentioned later), moreover, a pair of pins 25*i* are formed integrally on the rear end face of the rear collar portion 25*e*. The step portion 25*g* serves as escape means when the rearend bearing portion 25*d* is expanded by heat, which is generated by excitation of the coil 27. The escape means prevents the frictional resistance between the bearing portion 25*d* and a printing hammer 29 (mentioned later) from increasing.

The printing hammer 29, which is made of a magnetic material, is inserted in the bearing member 25. The hammer 29 is composed of a striker portion 29*a* and a shaft portion 29*b*, which are slidably supported by the bearing holes 25*c* and 25*f* of the front- and rear-end bearing portions 25*b* and 25*d*, respectively. A hole 29*c* is bored diametrically through the central portion of the hammer 29. The hole 29*c* serves to reduce the mass of the printing hammer 29, thereby improving its responsiveness.

A compression spring 31, for use as a resilient member, is located between the front-end bearing portion 25*b* and the shaft portion 29*b*. The spring 31 is wound in a conical form such that its diameter is greater on the side of the front-end bearing portion 25*b* than on the side of the shaft portion 29*b*. The printing hammer 29 is always urged toward its initial position, shown in FIG. 3, by the resilience of the spring 31.

On the rear-end side of the rear collar portion 25*e*, a yoke member 33, made of a magnetic material, is inserted into the case member 17 through the open ends of the supporting plates 21 and the mounting plates 23. An opening 33*a*, substantially corresponding in size to the bearing hole 25*f*, is formed in the central portion of the yoke member 33. The shaft portion 29*b* of the printing hammer 29 is passed through the opening 33*a*. The yoke member 33 is formed with a pair of apertures 33*b*, corresponding to the pins 25*i*. In assembling the printing hammer device 15, the pins 25*i* are inserted into their corresponding apertures 33*b*. The yoke member 33, the case member 17, and the hammer 29 form a magnetic path between them.

A hammer socket 35 is attached to the rear end face of the yoke member 33 with a rubber plate 37 between them. The hammer socket 35 has a mass great enough to absorb returning energy which is produced when the printing hammer 29, driven magnetically, is urged to return to the initial position by the resilience of the compression spring 31. The hammer socket 35 is in the form of a hat, having a flat portion 35*a* and a recessed portion 35*b* protruding backward from the central portion of the flat portion 35*a*. The flat portion 35*a* is formed with a pair of apertures 35*c*, corresponding to the pins 25*i*. The hammer socket 35 is movably supported by the pins 25*i* which are passed through the apertures 35*c*. The hammer socket 35 is positioned relatively to the yoke member 33. A plastic plate 35*d* is fixed in the recessed portion 35*b*.

A shock absorbing rubber member 39 is fitted on the outer peripheral surface of the recessed portion 35*b*. The rubber member 39 is in the form of a ring, including a small-diameter portion 39*a*, on the front-end side, and a large-diameter portion 39*b* equivalent in outside diameter to the hammer socket 35, on the rear-end side.

A supporting member 41 is used to hold and support the bearing member 25, printing hammer 29, yoke member 33, and the hammer socket 35 in the case member 17. The supporting member 41, which is formed by press-stamping, includes a pair of peripheral portions 41*a*, a pair of resilient arms 41*b*, and a pair of click legs 41*c*. Each peripheral portion 41*a* is bent so that its intermediate portion projects forward, thus abutting against the rear end face of the large-diameter portion 39*b* of the shock absorbing rubber member 39. Each resilient arm 41*b* is bent so that its free end portion engages the respective rear end faces of the hammer socket 35 and the large-diameter portion 39*b* of the rubber member 39. Each click leg 41*c* is bent so as to extend forward from the peripheral portions 41*a* and the proximal end of its corresponding resilient arm 41*b*, along the outer surface of its corresponding supporting plate 21 of the case member 17. A pair of click pieces 41*d* are formed at the front end portion of each click leg 41*c*, by stamping. The click pieces 41*d* are adapted to engage their corresponding notches 21*a* of the case member 17.

Referring now to FIGS. 2 to 5, there will be described the method of assembling the printing hammer device 15 of the aforementioned construction, and the way the device 15 is mounted on the character selection motor 11.

In FIG. 2, the bearing member 25 is inserted into the case member 17 via the open ends of the supporting plates 21 and the mounting plates 23. The front-end bearing portion 25*b* is passed through the opening 19*b*, with the arm portions 25*a* aligned individually with the notches 19*a*. At this time, the pins 25*h* of the front collar portion 25*e* are fitted individually into the apertures 19*c*, so that the case member 17 and the bearing member 25 are positioned relatively. Then, the printing hammer 29, with the compression coil spring 31 on its striking portion 29*a*, is inserted into the bearing member 25. In this case, the striker portion 29*a* and the shaft portion 29*b* of the hammer 29 are slidably supported by the bearing holes 25*c* and 25*f* of the front- and rear-end bearing portions 25*b* and 25*d*, respectively.

In this state, the yoke member 33 is attached to the rear collar portion 25*e* so that the nonstriking-side end portion of the shaft portion 29*b* penetrates the opening 33*a*. At this time, the pins 25*i* of the rear collar portion 25*e* are fitted individually into the apertures 33*b*, so that the bearing member 25 and the yoke member 33 are positioned relatively.

In the state described above, the hammer socket 35, with the shock absorbing rubber member 39 on the outer peripheral surface of its recessed portion 35*b*, is attached to the yoke member 33 so that the nonstriking-side end portion of the shaft portion 29*b* is fitted in the recessed portion 35*b*. At this time, the pins 25*i*, projecting through the rear end face of the rubber plate 37, are fitted individually into the apertures 35*c*, so that the yoke member 33 and the hammer socket 35 are positioned relatively.

Subsequently, the click legs 41*c* of the supporting member 41 are coupled individually to the supporting plates 21, from behind the hammer socket 35 mounted in the aforesaid manner, so that the click pieces 41*d* engage their corresponding notches 21*a* of the supporting plate 21. At this time, the peripheral portions 41*a* abut against the rear end face of the large-diameter portion 39*b*, while the resilient arms 41*b* engage the respective rear end faces of the large-diameter portion 39*b* and the hammer socket 35. Accordingly, the hammer socket 35 is urged forward by the resilience of the arms 41*b*. Thus, the bearing member 25, printing hammer 29, compression spring 31, yoke member 33, and hammer socket 35 are supported in the case member 17. In this state, the nonstriking-side end portion of the hammer 29 is pressed against the plastic plate 35*d* in the recess portion 35*b* by the urging force of the compression spring 31. Thus, the printing hammer 29 is situated in the initial position.

Figure 5:
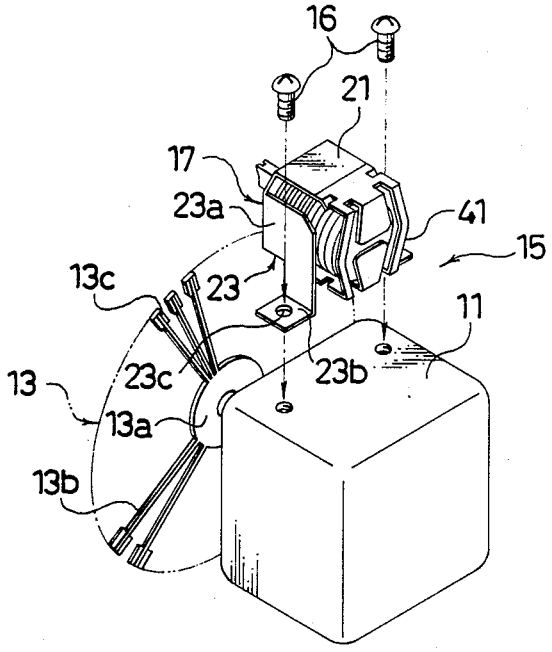
FIG. 5 is a perspective view for illustrating the way the printing hammer device is mounted on the printer.

FIG. 5 shows the way the printing hammer device 15 is mounted on the character selection motor 11. In FIG. 5, the hammer device 15, constructed in the aforesaid manner, is fixed directly to the top face of the motor 11 by means of the fixing screws 16, which penetrate the apertures 23*c* of the coupling portions 23*b*. Thus, the character selection motor 11 and the printing hammer device 15 are positioned with high accuracy. Accordingly, the striking-side end portion of the striker portion 29*a* can be opposed accurately, at a desired distance, to the character element 13*c* of the daisy wheel 13, which is situated in the printing position.

Figure 4:
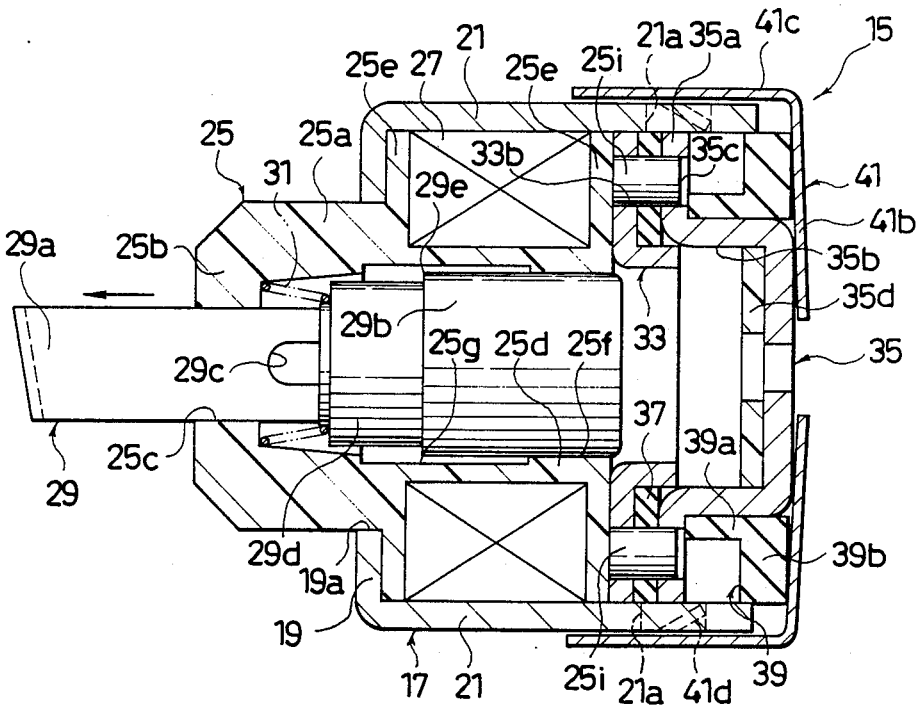
FIG. 4 is a sectional view, similar to FIG. 3, showing the printing hammer in its operative position.

Referring now to FIGS. 3 and 4, the operation of the printing hammer device 15, assembled in the aforesaid manner, will be described.

If no exciting current is applied to the coil 27, in the arrangement of FIG. 3, the printing hammer 29 is moved to the initial position shown in FIG. 3, by the urging force of the compression spring 31. In this state, the nonstriking-side end portion of the shaft portion 29*b* of the hammer 29 is fitted in the recessed portion 35*b* of the hammer socket 35 so as to abut against the plastic plate 35*d*.

In FIG. 4 showing the printing hammer device 15 in action, if an exciting current is applied to the coil 27, a magnetic field is generated by the magnetic path, which is formed between the case member 17 and the combination of the yoke member 33 and the printing hammer 29. By this magnetic field, the hammer 29 is moved, against the urging force of the compression coil 31, from the initial position shown in FIG. 3 to the operative position, in the direction indicated by the full-line arrow in FIG. 4. In this manner, the printing hammer 29 strikes the character element 13*c*, which is situated in the printing position in accordance with the print data, against the printing ribbon 14 on the printing sheet 5, with the desired impact. Thus, the print data is impact-printed.

When the coil 27 is de-excited with the progress of the printing operation, the printing hammer 29 is returned to the initial position by the urging force of the compression spring 31. The nonstriking-side end portion of the shaft portion 29*b*, fitted in the recessed portion 35*b*, impacts against the hammer socket 35, with returning energy corresponding to the urging force of the spring 31, thereby moving the hammer socket 35 toward the nonstriking side. At this time, the peripheral portions 41*a* and the resilient arms 41*b* of the supporting member 41 abut against the rear end face of the shock absorbing rubber member 39. As the hammer socket 35 moves, therefore, the rubber member 39, especially its small-diameter portion 39*a*, undergoes a substantial elastic deformation. Also, by means of the resilience of the peripheral portions 41*a* and the resilient arms 41*b*, the movement of the hammer socket 35 is buffered, and the returning energy of the printing hammer 29 is absorbed.

Since the resilient arms 41*b* are in contact with the rear end face of the hammer socket 35, moreover, the movement of the hammer socket 35 is buffered, and the returning energy of the printing hammer 29 is absorbed by the shock absorbing action of the shock absorbing rubber member 39, as well as by the resilience of the resilient arms 41*b*. By means of the elasticity of the rubber member 39 and the resilient force of the peripheral portions 41*a* and the resilient arms 41*b*, the hammer socket 35 is returned until it abuts against the rubber plate 37. In this manner, the printing hammer 29 is settled in the initial position.

According to this embodiment, as described above, the case member 17 and the character selection motor 11 are positioned relatively with high accuracy, by fixing the case member 17 directly to the motor 11 by means of the fixing screws 16, with the aid of the coupling portions 23*b*, which are formed integrally on the case member 17. By doing this, the striking-side end portion of the striker portion 29*a* of the printing hammer 29 can be opposed accurately, at the desired distance, to the character element 13*c* situated in the printing position. Thus, the printing hammer 15 can be mounted with ease, and the character elements 13*c* can be struck with the desired impact, thereby ensuring high-quality printing. If the coil 27 is broken, or if the striker portion 29*a* of the printing hammer 29 or the bearing member 25 is worn out, the click pieces 41*d* of the supporting member 41 can be disengaged from the notches 21*a* of the case member 17, without removing the case member 17 from the motor 11. Thus, the supporting member 41 can be removed easily from the case member 17, for the replacement of the individual components. In other words, expendable parts can be replaced with high efficiency.

Figure 6A:
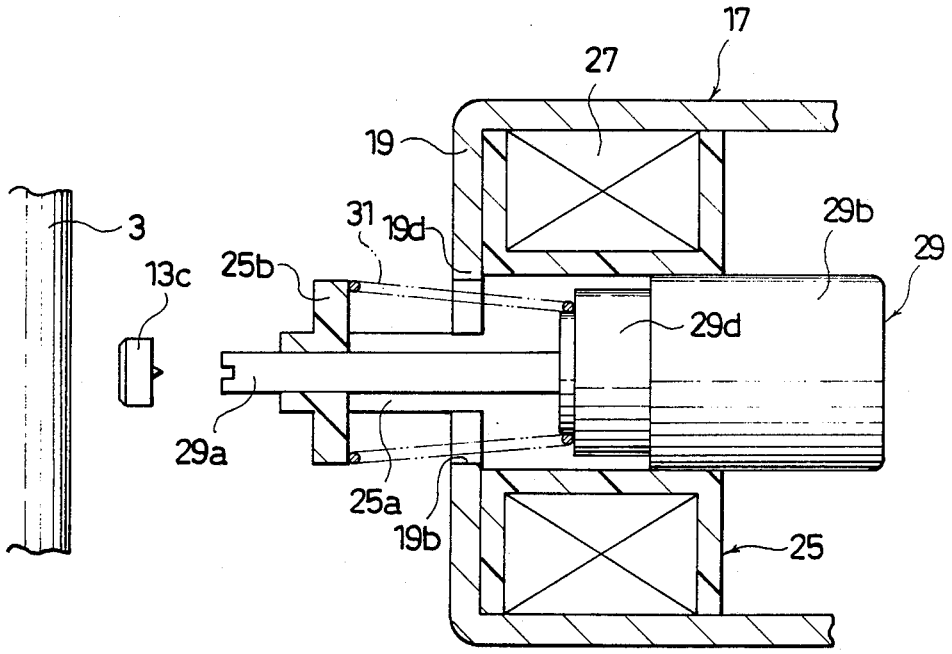
FIG. 6A is a partial sectional view, taken along line 6—6 of FIG. 3, showing the relative positions a platen and a character element.
Figure 6B:
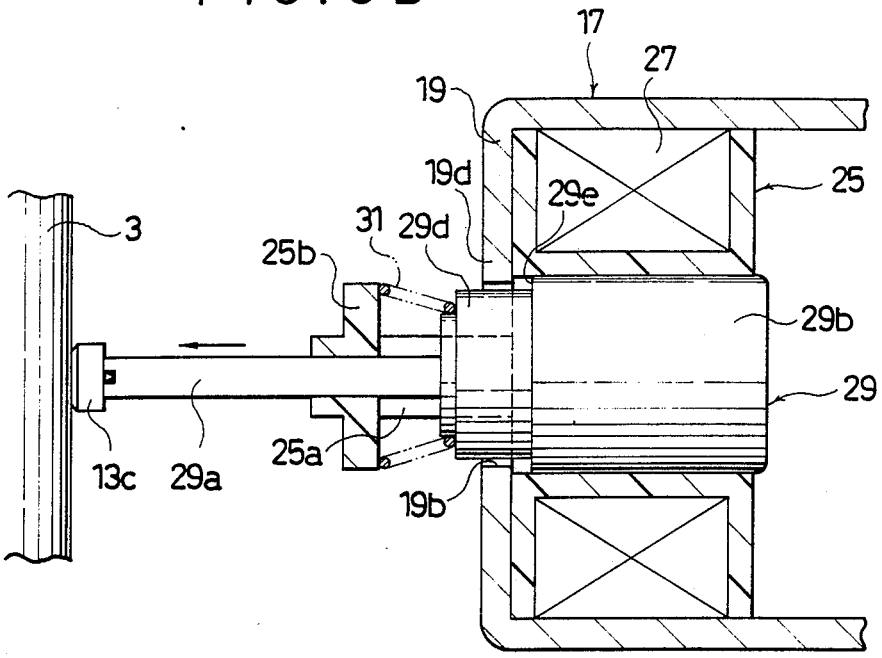
FIGS. 6B and 6C are sectional views, similar to FIG. 6A, showing a state such that the printing hammer of FIG. 6A is operated.
Figure 6C:
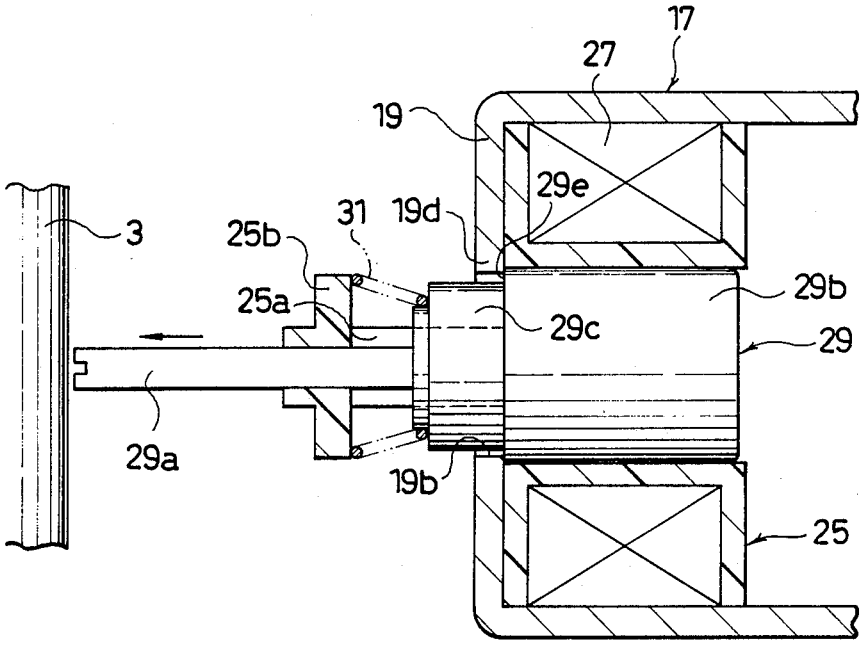

Referring now to FIGS. 6A, 6B and 6C, an arrangement for restricting the operative position of the printing hammer 29 will be described.

When the printing hammer 29 is kept in the initial position by the action of the compression spring 31, as shown in FIG. 6A, the spring 31 is stretched fully.

In printing, the printing hammer 29 is moved from the initial position toward the platen 3, in the operating direction, as indicated by the arrow in FIG. 6B. Thereupon, the striker portion 29*a* of the hammer 29 forwardly strikes the character element 13*c*, situated in the printing position, against the platen 3. In this state, the end face of a step portion 29*e*, which is formed between the shaft portion 29*b* and a small-diameter portion 29*d* of the hammer 29, is not yet in contact with a peripheral edge portion 19*d* of the opening 19*b*. The peripheral edge portion 19*d* constitutes stopper means for restricting the operative position of the hammer 29.

If the printing hammer 29 is operated without any of the character elements 13*c* in the printing position, however, then it is in the so-called lost motion. In such a case, the hammer 29 further moves toward the platen 3, as shown in FIG. 6C. Before the striker portion 29*a* abuts against the platen 3, however, the end face of the step portion 29*e* of the hammer 29 engages the stopper means or the peripheral edge portion 19*d*, which is smaller in diameter than the shaft portion 29*b*, thereby regulating the operative position. Accordingly, there is no possibility of the striker portion 29*a* striking directly against the platen 3. Moreover, the small-diameter portion 29*d* can neither engage the inside of the arm portions 25*a* of the bearing member 25, nor compress the compression spring 31 unduly. Thus, the spring 31 and its surroundings can be prevented from being damaged or distorted.

Alternatively, the stopper means may be provided on the corresponding portion of the bearing member 25 in sliding contact with the printing hammer 29.

Figure 7:
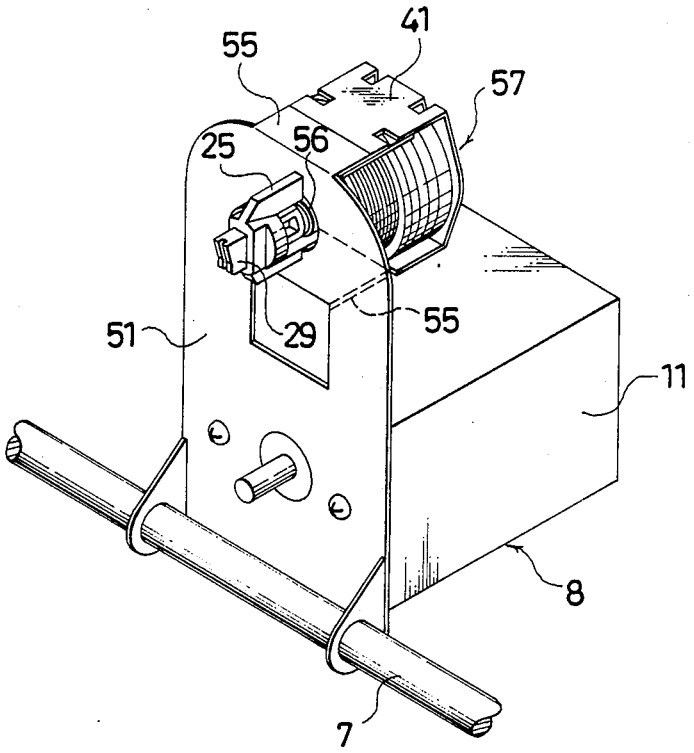
FIG. 7 is a perspective view showing a principal part of a printer having a printing hammer device according to a second embodiment of the present invention.

Referring now to FIG. 7, a second embodiment of the present invention will be described. In the description to follow, like reference numerals are used to designate like portions as described in connection with in the first embodiment.

In this second embodiment, a mounting plate 51, which, along with the character selection motor 11, constitutes the traveling member 8, is slidably supported, at its proximal end portion, on the guide shaft 7 of the printing apparatus. The motor 11 is mounted on the mounting plate 51. A part of the free end portion of the mounting plate 51 is shaped, by press-stamping, so that it can serve in place of the case member 17 of the first embodiment. At such an integral part, upper and lower supporting plates 55 are formed, facing each other, by bending and stamping, respectively. An opening 56 is formed in the integral part of the mounting plate 51, in which the bearing member 25, printing hammer 29, and other components are mounted by means of the supporting member 41, in the same manner as in the first embodiment. Thus, a printing hammer device 57 is assembled.

Figure 8:
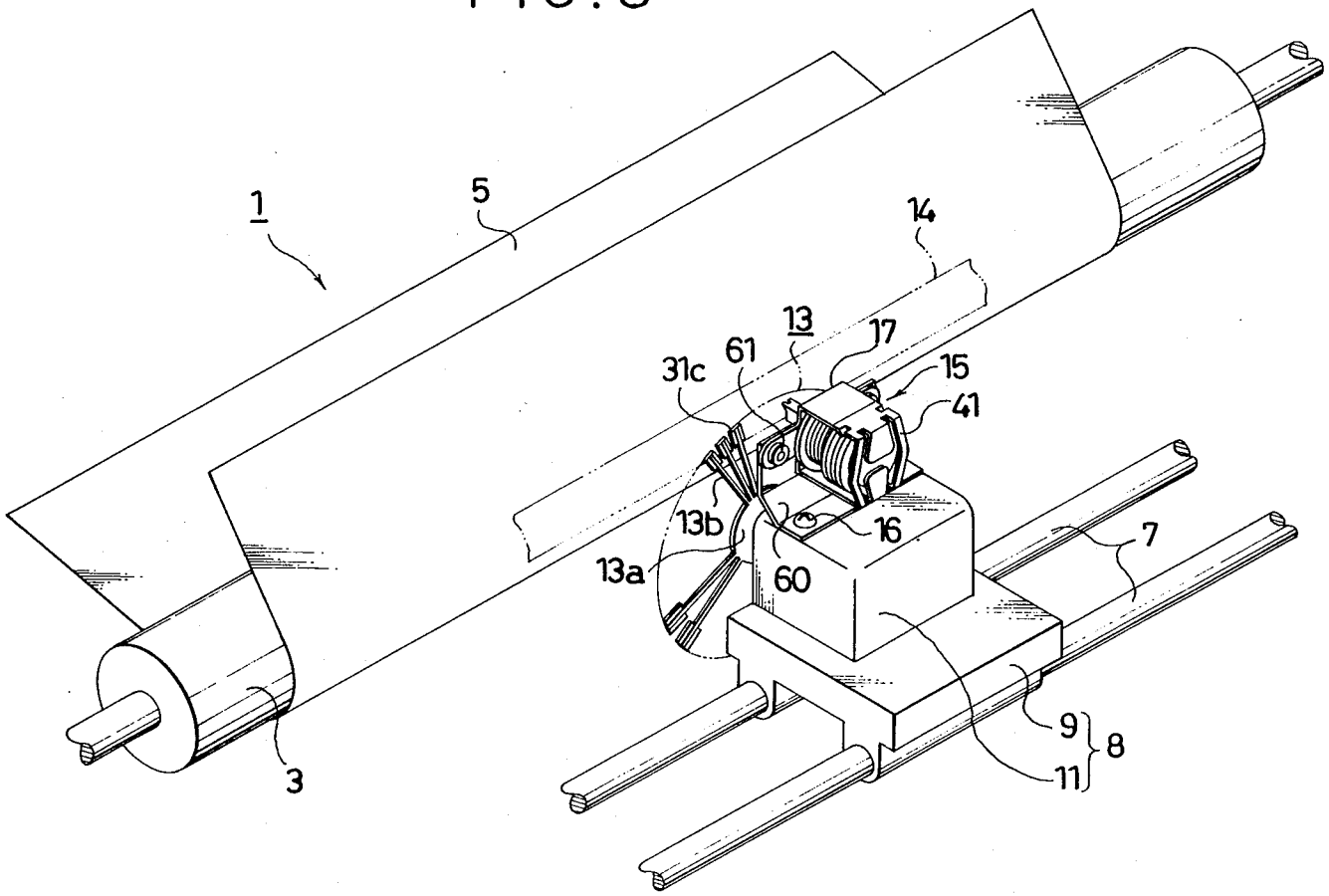
FIG. 8 is a perspective view showing a principal part of an impact printer having a printing hammer device according to a third embodiment of the present invention.
Figure 9:
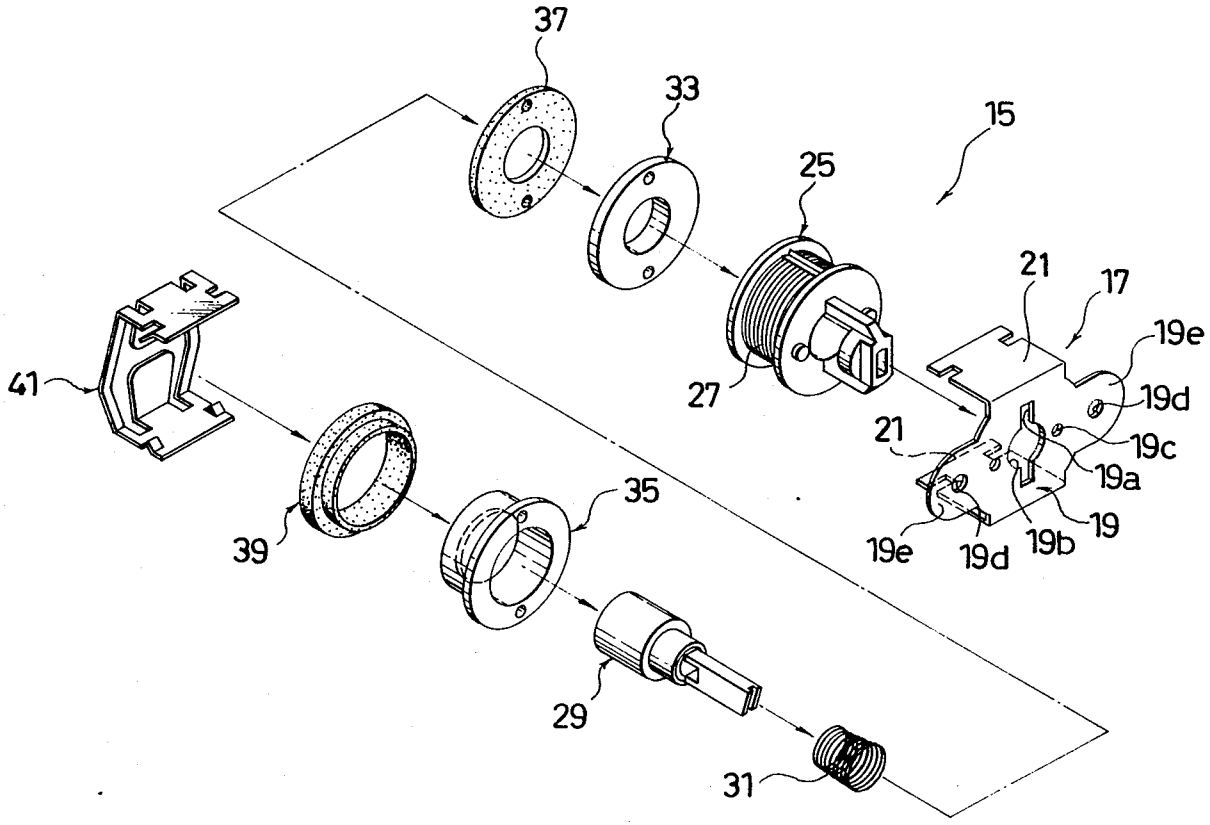
FIG. 9 is an exploded perspective view of the printing hammer device shown in FIG. 8.
Figure 10:
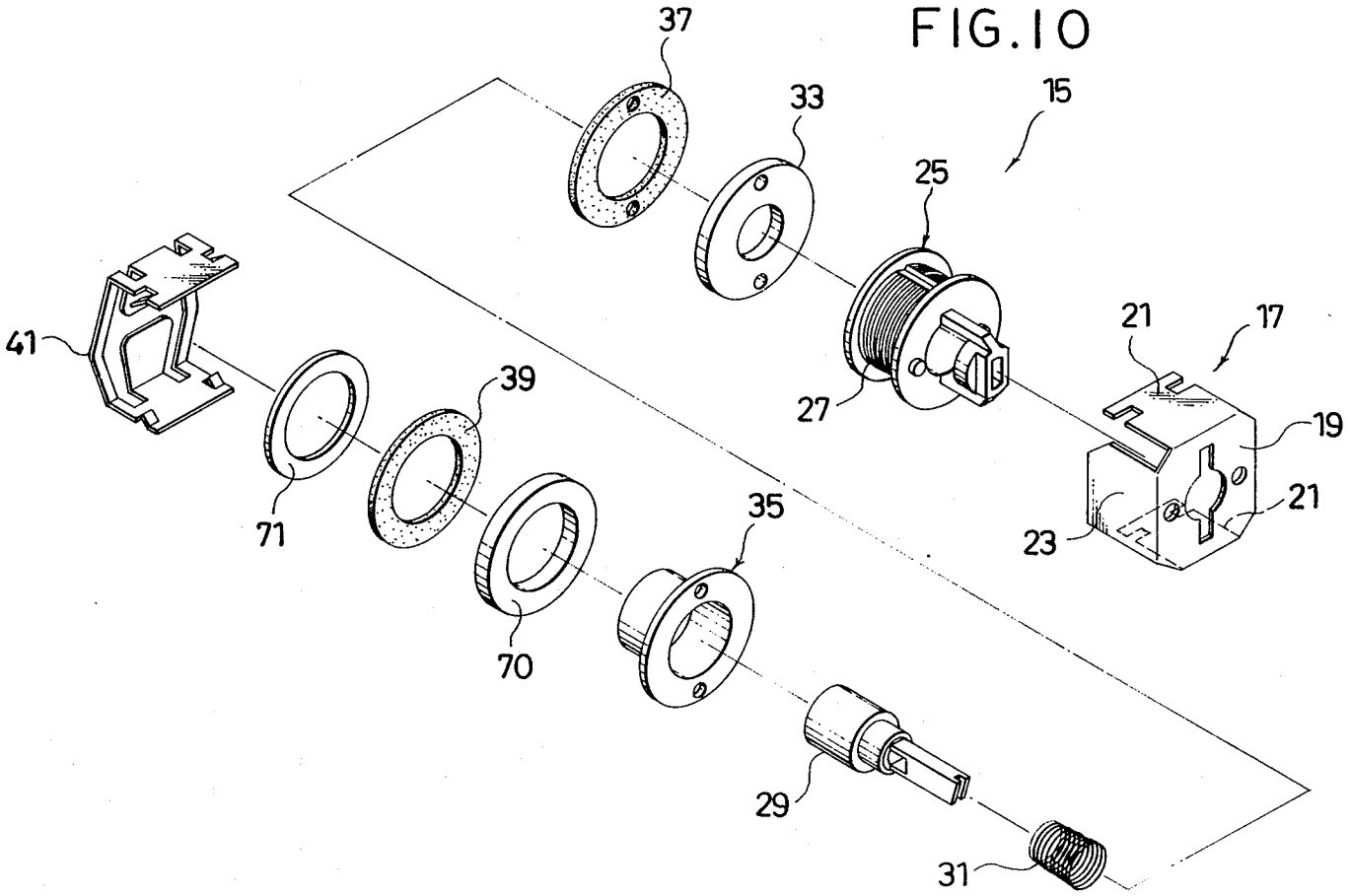
FIG. 10 is an exploded perspective view of a printing hammer device according to a fourth embodiment of the present invention.

FIGS. 8 and 9 show a third embodiment of the present invention, which is constructed substantially in the same manner as the first embodiment, except for the arrangement of the case member 17. In the description to follow, therefore, like reference numerals are used to designate like portions as included in the first embodiment, for simplicity of illustration.

In the case member 17 of the third embodiment, the front plate 19, which is formed with the opening 19*b*, the paired notches 19*a* continuous with the opening 19*b*, and the paired apertures 19*c* on either side of the opening 19*b*, has a pair of lateral extension pieces 19*e*. A screw hole 19*d* is bored through each extension piece 19*e*.

In the third embodiment, as shown in FIG. 8, the case member 17 is mounted on the character selection motor 11 on the carriage 9, in the following manner. First, a holder 60 is fixed to the motor 11 by means of fixing screws 16. Then, the extension pieces 19*e* of the front plate 19 of the case member 17 are held against the holder 60 so that the screw holes 19*d* are in alignment with their corresponding mounting holes (not shown) of the holder 60. Finally, the front plate 19 is fixed to the holder 60 by means of fixing screws 61.

As in this embodiment, the printing hammer device 15 can be mounted on the traveling member 8 with the aid of the holder 60, which is formed independently of the case member 17.

FIGS. 10 to 13 show a fourth embodiment of the present invention, which is constructed substantially in the same manner as the first embodiment. In the description to follow, therefore, like reference numerals are used to designate like portions as included in the first embodiment, for simplicity of illustration.

In the fourth embodiment, a ring-shaped inertia member 70 is interposed between the hammer socket 35 and the shock absorbing rubber member 39, while a ring-shaped washer 71 is sandwiched between the rubber member 39 and the supporting member 41.

The inertia member 70, along with the rubber member 39 and the washer 71, is fitted on the outer peripheral surface of the recessed portion 35*b* of the hammer socket 35, so as to be slidable along the moving direction of the printing hammer 29.

Figure 11:
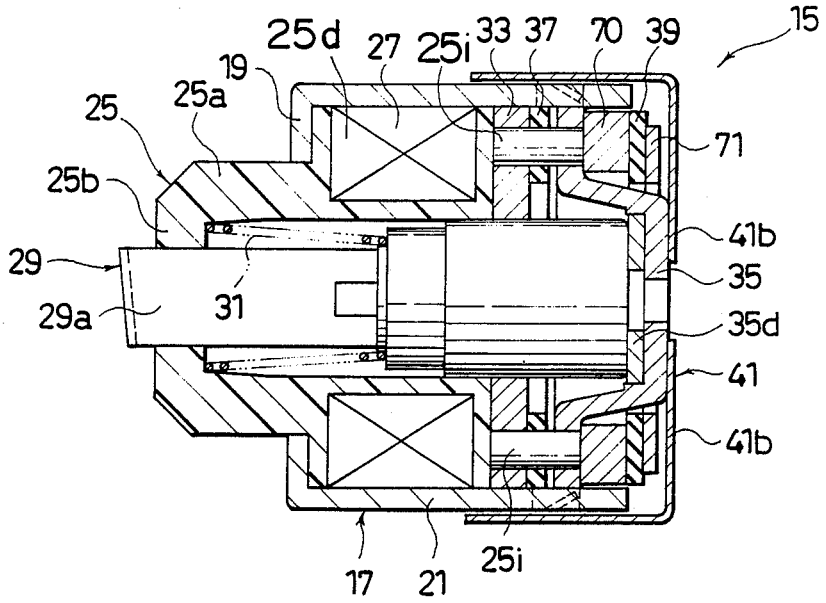
FIG. 11 is an enlarged longitudinal section view of the printing hammer device of FIG. 10, in a state such that its printing hammer is in its initial position.
Figure 12:
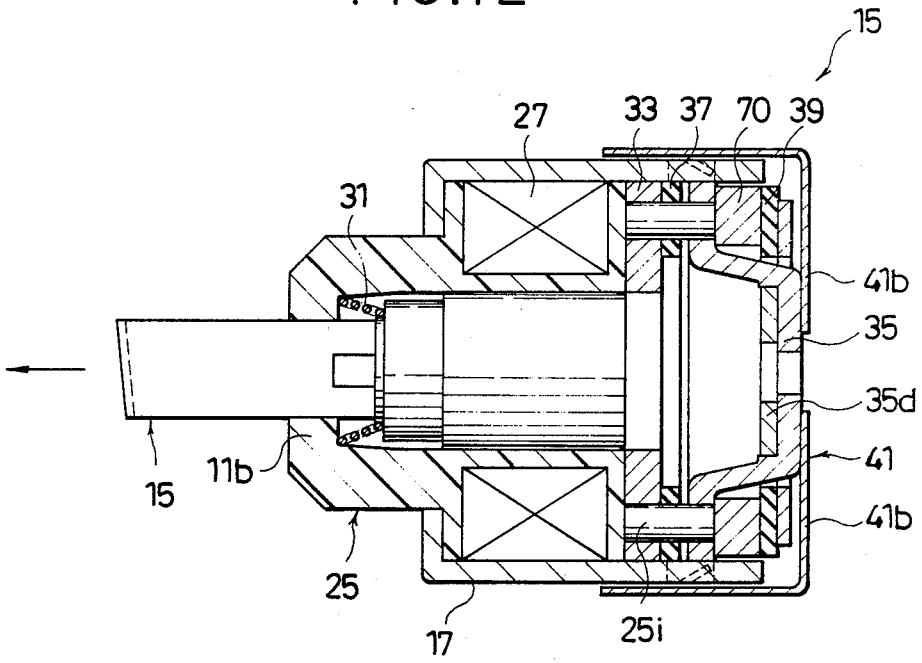
FIG. 12 is a sectional view, similar to FIG. 11, showing the printing hammer in its operative position.

FIGS. 11 and 12 show states in which the printing hammer 29 is in its initial position and operative position, respectively. The hammer 29 moves from the initial position to the operative position, in the direction indicated by the arrow in FIG. 12.

Figure 13:
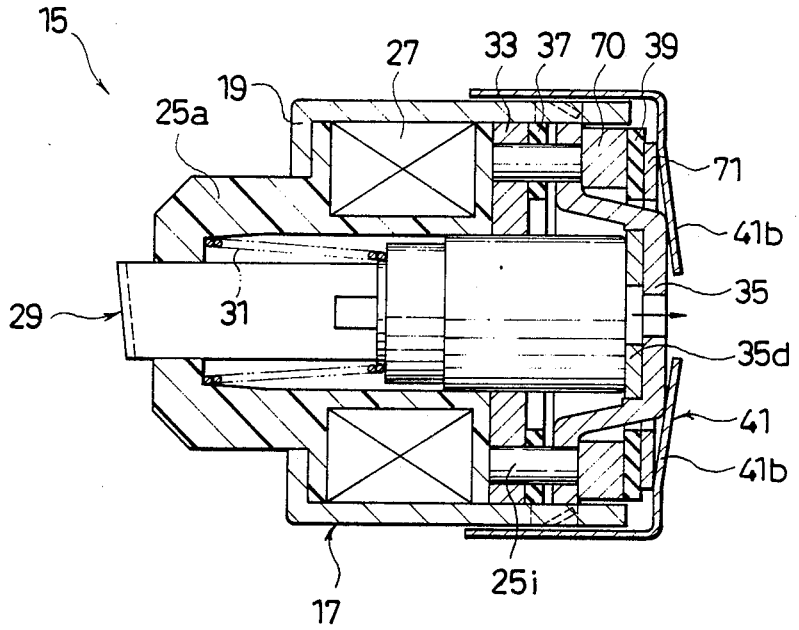
FIG. 13 is a sectional view, similar to FIG. 11, illustrating the operation of the printing hammer device.

FIG. 13 illustrates a process of operation of the printing hammer 29 such that the coil 27 is de-excited, thus allowing the hammer 29 to be returned to the operative position, in the direction of the arrow, by the action of the spring 31.

Receiving returning energy corresponding to the urging force of the spring 31, the printing hammer 29 first strikes against the hammer socket 35. Thereupon, the hammer socket 35 moves in the direction of the arrow, and abuts against the paired resilient arms 41*b* of the supporting member 41, thereby deforming them elastically. Such a movement of the hammer socket 35 is transmitted immediately to the inertia member 70, so that the inertia member 70 is moved in like manner. This movement of the inertia member 70 is transmitted to the rubber member 39, the washer 71, and the paired peripheral portions 41*a* of the supporting member 41, which engage the washer 71. In this manner, the peripheral portions 41*a* are deformed elastically.

Thus, the returning energy is absorbed partially by the resilient arms 41, while the returning energy transmitted from the hammer socket 35 to the inertia member 70 is absorbed considerably by the mass of the member 70 itself, and also by the rubber member 39 and the peripheral portions 41*a*. As a whole, the energy can be absorbed quickly and fully.

Moreover, the inertia member 70 is subjected to a reaction force by the resilience of the peripheral portions 41*a* and the rubber member 39. Accordingly, the member 70 is moved opposite to the returning direction of the printing hammer 29, thus abutting against the hammer socket 35. Such a reaction force, however, is damped by the mass of the inertia member 70, and is absorbed fully by the ring-shaped rubber plate 37. Therefore, the printing hammer 29 itself can hardly be moved from the initial position.

Thus, the printing hammer 29 can be settled in its return position in a short time, without undesired rebounding.

Figure 14:
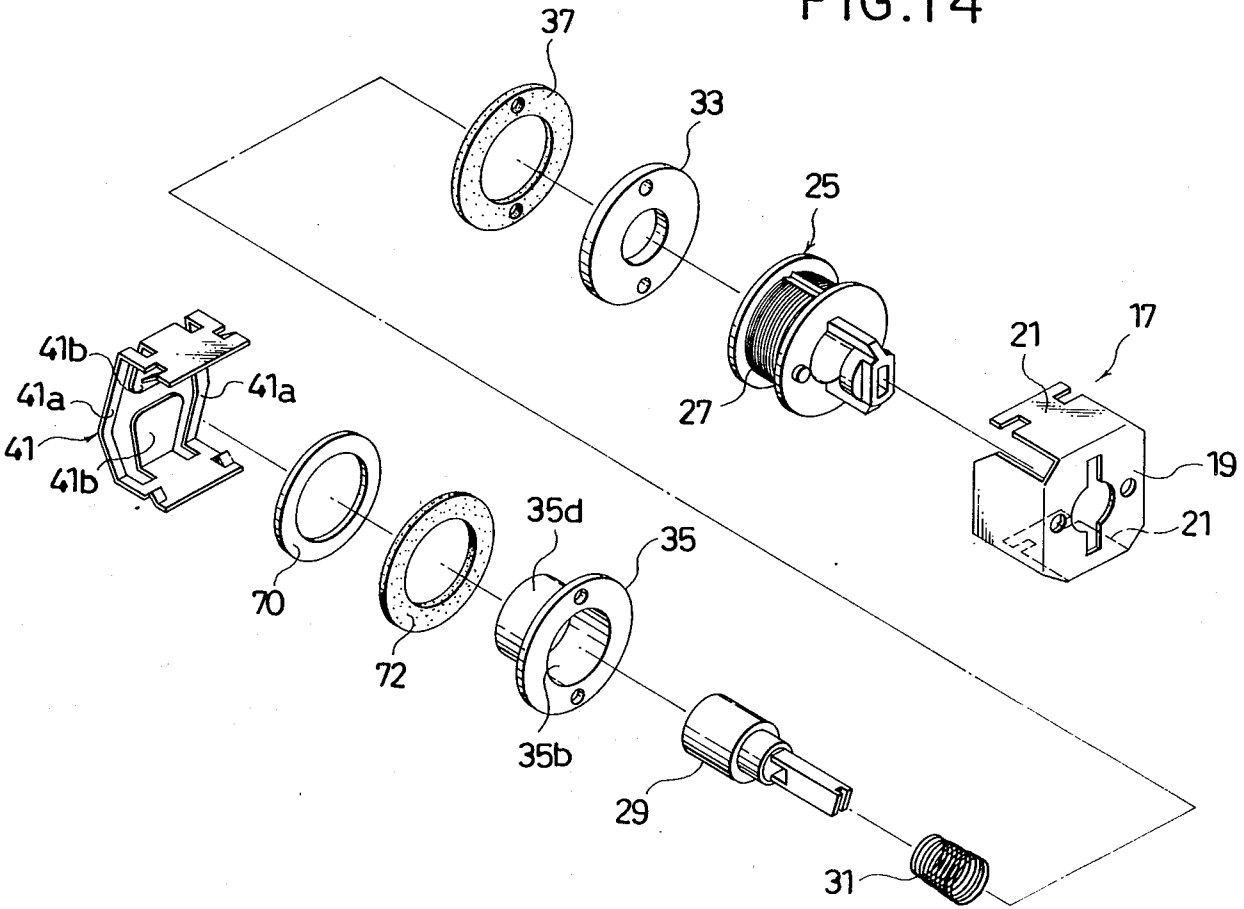
FIG. 14 is an exploded perspective view of a printing hammer device according to a fifth embodiment of the present invention.

According to the embodiment described above, the inertia member 70 is mounted on the outer peripheral surface 35*d* of the hammer socket 35, for axial movement, and the ring-shaped shock absorbing rubber member 39 is interposed between the member 70 and the resilient supporting member 41. However, as in a fifth embodiment of the present invention, shown in FIG. 14, a ring-shaped rubber magnet 72 may be disposed between the inertia member 70 and the flat portion 35*a* of the hammer socket 35. In this case, the peripheral portions 4*a* of the supporting member 41 are made to abut directly against the rear end face of the member 70. When the printing hammer 29 is returned to its initial position by the urging force of the compression spring 31, in such an arrangement, the inertia member 70 is moved against the magnetic attraction of the rubber magnet 72, acting on the hammer socket 35, and the peripheral portions 41*a* are subjected to elastic deformation. Thus, most of the returning energy of the hammer 29 is absorbed. Thereafter, the residual returning energy in the member 70, moving toward the striking side, is absorbed by the rubber magnet 72, thereby preventing the printing hammer 29 from rebounding. In this manner, the hammer 29 can be settled in the initial position in a short time.

In connection with both of the fourth and fifth embodiments, the arrangement for mounting the printing hammer device on the printing apparatus is not illustrated. In these embodiments, however, the hammer device can be mounted just in the same manner as in the first to third embodiments.

It is to be understood that the present invention is not limited to the embodiments described above, and that various changes and modifications may be effected therein by one skilled in the art without departing from the scope or spirit of the invention.

What is claimed is:

1. In a printing hammer device which is disposed on a printing apparatus having a platen and a plurality of character elements, in a printing position, against the platen, said printing hammer device comprising:

a case member;

a printing hammer including a striking-side end portion for striking the character elements and a nonstriking-side end portion;

bearing means for supporting the printing hammer on the case member, in a manner such that the hammer is movable between an initial position and an operative position;

magnetic drive means for moving the printing hammer in one direction along an axis of movement;

resilient means for returning the printing hammer in the other direction along the axis of movement;

a hammer socket abutting against the nonstriking-side end portion of the printing hammer when the hammer is moved to the initial position;

a shock absorbing rubber member for absorbing the impact of the printing hammer on the hammer socket, said shock absorbing rubber member having a through hole along the axis of movement of the printing hammer; and a resilient supporting member including a pair of peripheral portions which resiliently engage only the shock absorbing rubber member, and a resilient arm which resiliently engages a portion of the hammer socket extending through said through hole toward said resilient arm and urges the portion of the hammer socket.

2. The printing hammer device according to claim 1, further comprising: an inertia member movable in the same direction as the moving direction of the printing hammer, receiving returning energy from the hammer through the hammer socket when the hammer impacts against the hammer socket.

3. The printing hammer device according to claim 2, wherein said inertia member has a through hole along the moving direction of the printing hammer so as to allow the hammer socket and the resilient arm of the resilient supporting member to engage each other directly.

4. The printing hammer device according to claim 2, further comprising: a ring-shaped rubber magnet interposed between the hammer socket and the inertia member.

5. The printing hammer device according to claim 1, wherein said resilient supporting member is formed integrally from a leaf spring material.

6. The printing hammer device according to claim 1, wherein a hole is formed in an intermediate portion between said striking- and nonstriking-side end portions of the printing hammer, whereby the mass of the hammer is reduced.

7. The printing hammer device according to claim 1, wherein said shock absorbing rubber member is in the form of a ring, and includes a small-diameter portion which is able to be deformed when the printing hammer strikes against the hammer socket, thereby absorbing the returning energy of the printing hammer.

8. In a printing hammer device which is disposed on a printing apparatus having a platen and a plurality of character elements, and executes printing by striking one of the character elements, in a printing position, against the platen, said printing hammer device comprising:

a case member;

a printing hammer including a striking-side end portion for striking the character elements and a nonstriking-side end portion;

bearing means for supporting the printing hammer on the case member, in a manner such that the hammer is movable between an initial position and an operative position;

magnetic drive means for moving the printing hammer in one direction;

resilient means for returning the printing hammer in the other direction;

a hammer socket abutting against the nonstriking-side end portion of the printing hammer when the hammer is moved to the initial position;

shock absorbing means for absorbing the impact of the printing hammer on the hammer socket;

a resilient supporting member including a pair of peripheral portions which resiliently engage only the shock absorbing means, and a resilient arm which resiliently engages a portion of the hammer socket; and said shock absorbing means including a ring-shaped inertia member movable in the same direction as the moving direction of the printing hammer, receiving returning energy from the hammer through the hammer socket when the hammer impacts against the hammer socket.

9. The printing hammer device according to claim 8, wherein said shock absorbing means further includes a ring-shaped rubber plate interposed between the inertia member and resilient supporting member.

10. The printing hammer device according to claim 9, wherein said pair of peripheral portions of said resilient supporting member are bent at the respective intermediate portions to project toward the shock absorbing means, and a ring-shaped washer is interposed between the ring-shaped rubber plate and the pair of peripheral portions of the resilient supporting member.

11. In a printing hammer device which is disposed on a printing apparatus having a platen and a plurality of character elements, and executes printing by striking one of the character elements, in a printing position, against the platen, said printing hammer device comprising:

a printing hammer movable between an initial position and an operative position, said printing hammer including a striking-side portion for striking the character elements and a nonstriking-side end portion;

a coil bobbin including a through hole through which said printing hammer is movable along its axial direction, a projected portion projecting from one end of the coil bobbin, a first bearing position formed at a distal end of the projected portion for bearing the striking-side end portion of the printing hammer, and a second bearing portion formed at the other end of the coil bobbin for bearing the nonstriking-side end portion of the printing hammer;

a coil wound around the coil bobbin;

a case member made of magnetic material and receiving said coil bobbin, said case member having one end portion provided with an opening and a side portion axially extending along the periphery of the coil from said one end portion, the other end of the case member being open;

said opening of the case member having a peripheral open edge which is disposed close to said through hole of said coil bobbin;

a ring-shaped yoke member which is made of magnetic material and is disposed at the other end of said coil bobbin, said yoke member having an outer peripheral edge extending close to the side portion of said case member and an opening in the central portion thereof through which said nonstriking-side end portion of the printing hammer is allowed to pass, said opening of the yoke member being provided with an inner peripheral edge extending close to an outer surface of the nonstriking-side end portion of the printing hammer.

resilient means for returning the printing hammer to the initial position;

a hammer socket abutting against the nonstriking-side end portion of the printing hammer when the hammer is moved to the initial position;

a supporting member for supporting said hammer socket on the case member; and a magnetic path being formed through said one end and side portions of the case member, said yoke member and said nonstriking-side end portion of the printing hammer upon excitation of the coil, thereby actuating the nonstriking-side end portion of the printing hammer to move toward the one end portion of the case member.

12. The printing hammer device according to claim 11, wherein said second bearing portion is mounted on the coil bobbin.

13. The printing hammer device according to claim 11, wherein said projected portion of the coil bobbin includes a pair of arms provided with respective distal ends in which said first bearing portion is formed and serves to prevent the printing hammer from rotating around its axis; said opening of the case member has a pair of notches with which said pair of arms are fitted respectively, thereby preventing the first bearing portion from rotating around its axis in relation to the case member.

14. The printing hammer device according to claim 11, wherein said striking-side end portion of the printing hammer is flat and said nonstriking-side end portion thereof is cylindrical; said nonstriking-side end portion of the printing hammer has a diameter which is larger than that of the opening of the case member so that said peripheral open edge of the opening constitutes stopper means for restricting the operative position of the printing hammer, whereby the striking-side end portion of the printing hammer is prevented from abutting against the platen when the printing hammer is operated with none of the character elements in the printing position.

15. The printing hammer device according to claim 11, wherein said supporting member has coupling means between the supporting member and the case member, whereby said supporting member is removably coupled to the case member after the coil bobbin, the printing hammer, the resilient means, and the hammer socket are fitted into the case member through the open end portion thereof.

16. The printing hammer device according to claim 11, further comprising:

first positioning means interposed between the coil bobbin and the case member, whereby the coil bobbin and the case member are prevented from rotating relatively around the axis of movement of the printing hammer; and second positioning means interposed between the coil bobbin and the hammer socket, whereby the coil bobbin and the hammer socket are prevented from rotating relatively around the axis of movement of the hammer, said second positioning means including at least a pair of pins protruding from the coil bobbin along the moving direction of the printing hammer.

* * * * *